US005964617A

United States Patent [19]

Hoang et al.

[11] Patent Number: 5,964,617

[45] Date of Patent: Oct. 12, 1999

[54] ACCESS PANEL WITH BLIND CONNECTOR

[75] Inventors: Quynh Hoang; Ronald Wayne Guess, both of Evansville; John Ricard Wisnoski, Haubstadt, all of Ind.

[73] Assignee: Whirlpool Corporation, Benton Harbor, Mich.

[21] Appl. No.: 09/036,298

[22] Filed: Mar. 6, 1998

[51] Int. Cl.[6] ..... H01R 13/60

[52] U.S. Cl. ..... 439/528

[58] Field of Search ..... 439/528, 553

[56] References Cited

U.S. PATENT DOCUMENTS 1,648,582 11/1927 Dodge, Jr. .
3,651,446 3/1972 Sadogierski et al. .
5,460,530 10/1995 Toba et al. ..... 439/34
5,574,256 11/1996 Cottone ..... 174/53
5,630,728 5/1997 Watters, Jr. ..... 439/528

*Primary Examiner*—Gary Paumen
*Attorney, Agent, or Firm*—Robert O. Rice; Stephen D. Krefman; Thomas J. Roth

[57] ABSTRACT

A blind connector is provided on an access panel. The access panel covers an access opening in a wall of an apparatus. The wall separates an access area from a connective element such as a harness on the other side of the wall. The blind connector holds the connective element by a connector on the connective element. The blind connector makes the connective element readily available when the access panel is removed. This improved access panel provides easy access to an ice maker harness in the freezer portion of a refrigerator-freezer for the later connection of an ice maker kit.

12 Claims, 3 Drawing Sheets

ACCESS PANEL WITH BLIND CONNECTOR

BACKGROUND OF THE INVENTION

1. Field of the Invention

The present invention relates to an access panel that covers an access opening in a wall of an apparatus. The wall separates a connective element, such as a harness, that is behind the wall from an access area that is on the front side of the wall. Opening the access panel allows the connective element to be pulled through the access opening and into the access area.

2. Description of the Related Art

It is often advantageous to provide with a first apparatus, something that will be required for use by a later installed second apparatus. The first apparatus might provide any of the following types of useful things like: power, control, a material to be processed, etc. that is utilized by the second apparatus. In this particular application, the first apparatus is a refrigerator-freezer and the second apparatus is an ice maker kit that is field installed in the freezer of the refrigerator-freezer. An ice maker harness with connector is provided with the refrigerator-freezer to provide power and control for the later installed ice maker. Also, a portion of the water fill tubing for the ice maker is supplied with the refrigerator-freezer.

Presently, a refrigerator-freezer that is produced with provisions to later install an ice maker in kit form, has an access panel in an access area of the freezer portion of the appliance. During installation of the ice maker, the installer, working in the access area, is instructed to remove the access panel and to provide openings in the access panel by breaking off or knocking out specific pieces of the access panel that are designed to be broken off or knocked out. The installer is further instructed to pull the ice maker harness out of the access opening from the region behind the internal freezer wall, and hang it over the edge of the access opening. Also, the installer is instructed not to pull any other wiring through the access opening. The installer is then instructed to place a water fill tube extension that is provided with the ice maker kit over the end of the water fill tubing that is accessible through the access opening. The installer is later instructed to reinstall the access panel over the access opening with the ice maker harness and water fill tube extension respectively protruding through the slot and hole made by the modification of the access panel.

The present approach puts a sometimes difficult burden on the installer. The installer must find the correct harness for the ice maker, which is often buried in the freezer's insulation, and not pull out other wiring that is not for the ice maker. All of this can take a substantial amount of time.

SUMMARY OF THE INVENTION

The deficiencies of the present system are overcome by the invention. A blind connector is provided on the improved access panel, to which a connector on the ice maker harness is connected at the time the refrigerator-freezer is being produced. During later installation of the ice maker kit, the installer is instructed to remove the access panel. As the installer removes the access panel the ice maker harness that is connected to the blind connector provided on the access panel is pulled through the access opening. Therefore, the correct harness for the ice maker is immediately available to the installer without having to search through the access opening, and the chance of pulling out the wrong wires is eliminated.

DESCRIPTION OF THE PREFERRED EMBODIMENT

Figure 1:
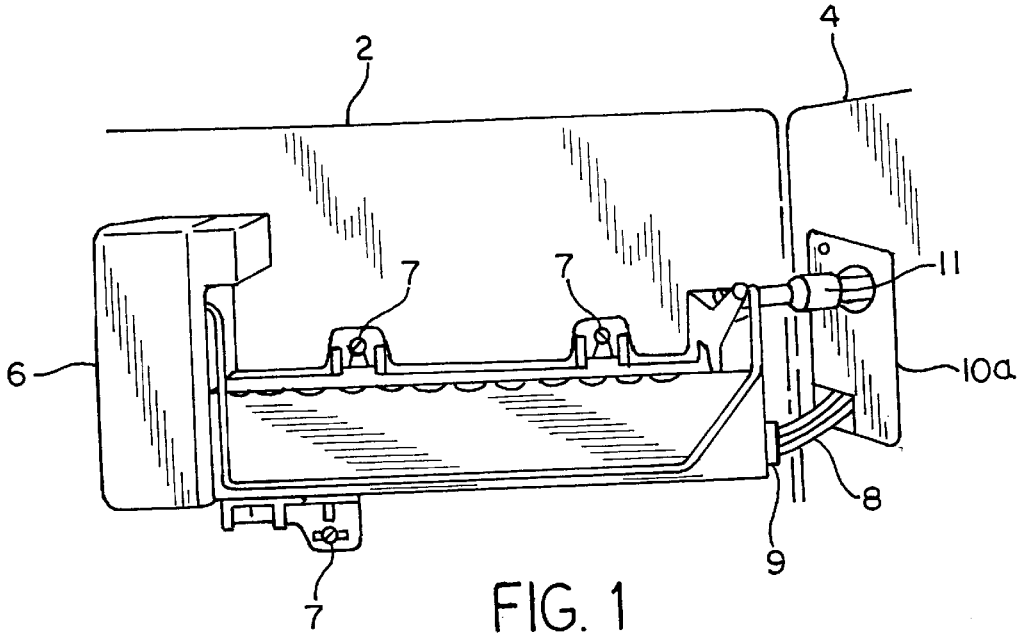
FIG. 1 is a perspective view of an ice maker kit installed in a freezer section of a refrigerator freezer.

FIG. 1 illustrates a freezer sidewall 2 and a freezer backwall 4 with an ice maker 6 installed. The ice maker 6 is attached to sidewall 2 by screws 7. The ice maker 6 is powered and controlled by the ice maker wiring harness 8 that proceeds from behind the freezer backwall 4 through access panel 10*a*. Also, ice maker 6 is filled from a water fill tube extension 11 that also proceeds from behind the freezer backwall 4 through access panel 10*a*. FIG. 1 illustrates the present invention as well as prior art as it shows a modified access panel 10*a* with the wiring harness 8 and the water fill extension 11 proceeding through the modified access panel 10*a* and the ice maker 6 after installation of the ice maker 6 in a freezer.

Figure 2:
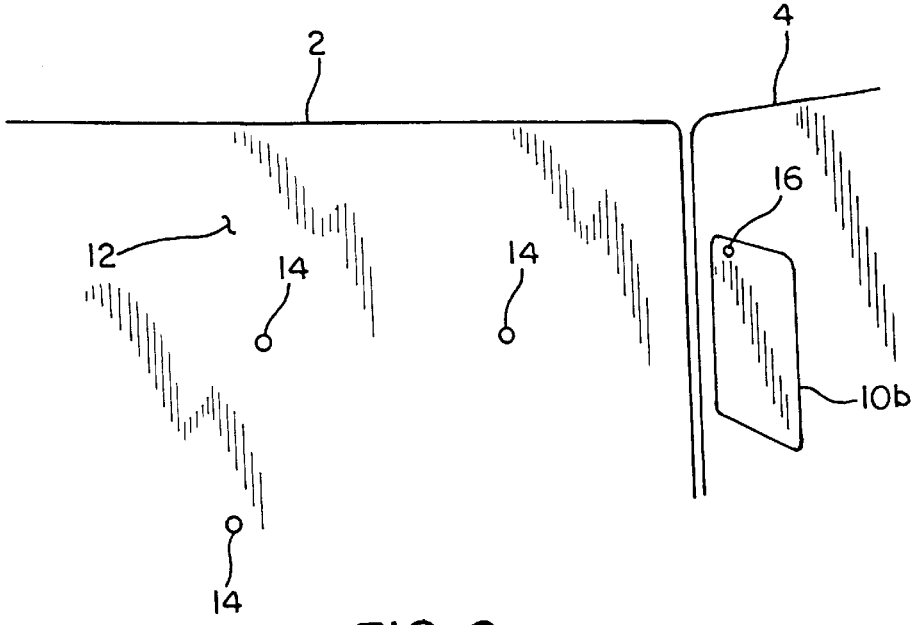
FIG. 2 is a perspective view of the access area and access panel of a freezer section before installation of the ice maker kit.

FIG. 2 illustrates an access area 12 that is bordered by freezer sidewall 2 and freezer backwall 4. Mounting holes 14 in freezer sidewall 2 receive screws 7 (FIG. 1) to mount ice maker 6 to freezer sidewall 2. Fastener 16, such as a screw, secures access panel 10*b* to freezer backwall 4. FIG. 2 also illustrates the present invention as well as prior art as it shows an access panel 10*b* before the installation of the ice maker 6 in a freezer.

Figure 3:
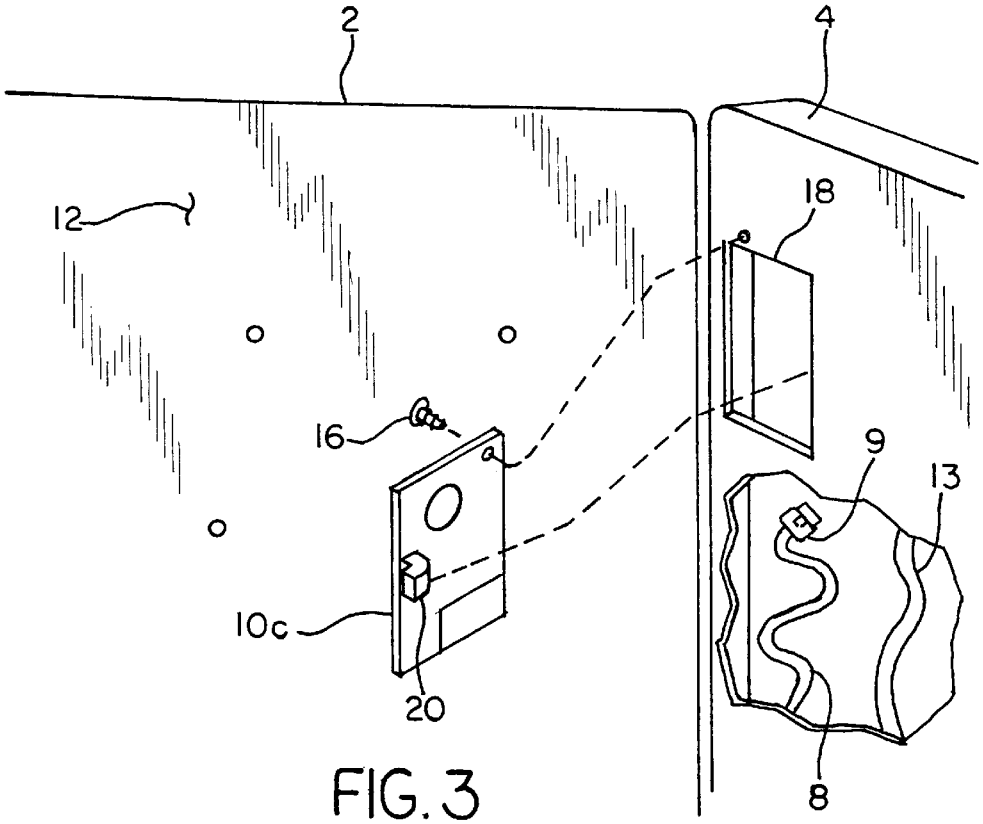
FIG. 3 PRIOR ART
FIG. 3 is a view similar to FIG. 2 showing a prior art access panel removed.

FIG. 3 illustrates access area 12 with a prior art access panel 10*c* removed from an access opening 18. To gain access to access opening 18, fastener 16 is removed from the access panel 10*c*. There after, access panel 10*c* maybe moved to the left unhooking a tab 20 from the freezer backwall 4 and then the access panel 10*c* maybe removed from access opening 18. An ice maker wiring harness 8 is shown (through a cutout in backwall 4) that has one end provided with a connector 9 for connecting the harness 8 to the ice maker 6. Access to ice maker wiring harness 8 that is behind the freezer backwall 4 and between backwall 4 and a freezer external wall (not shown) is achieved by reaching through access opening 18 and searching by touch. When ice maker wiring harness 8 is located it may be pulled through access opening 18 and connector 9 connected to ice maker 6 before ice maker 6 is installed. Also shown is other wiring 13 (through the cutout in backwall 4), other wiring 13 is not used by ice maker 6 and should not be pulled through access opening 18.

Figure 4:
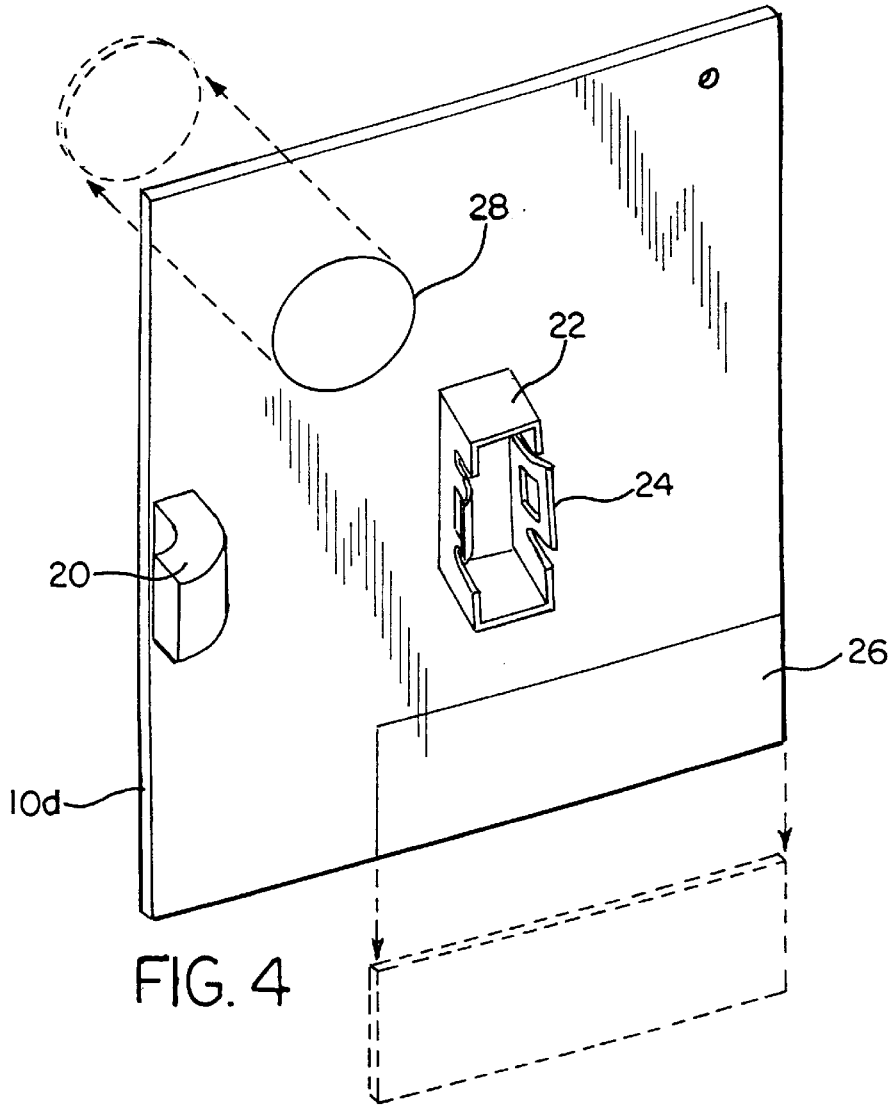
FIG. 4 is a perspective view of the improved access panel.
Figure 6:
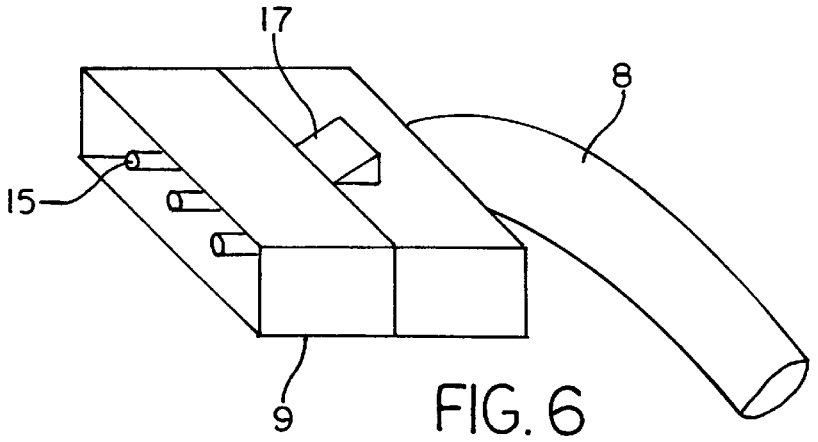
FIG. 6 is a perspective view of a harness connector for an ice maker.

FIG. 4 illustrates the invention in an improved access panel 10*d* that provides a blind connector 22 on a back side there of for connection to harness connection 9. Blind connector 22 has flexible spreadable tabs 24 on two opposite sides such that connector 9 maybe inserted into blind connector 22 between the tabs 24. Tabs 24 then capture protrusions 17, such as locking ramps (FIG. 6) of connector 9, and keeps connector 9 inserted into blind connector 22, which holds connector 9 inplace against access panel 10*d*.

The harness connection 9 with the ice maker wiring harness 8 attached may be attached to the blind connector 22 at the time of production and will remain so attached until the time of installation of an ice maker 6. The spreadable tabs 24 are easily spread to free harness connection 9 at the time of installation. FIG. 4 also shows a break-off section 26 and a knock-out section 28 in an alternate position after the particular section has been broken off or knocked out to allow the water fill tub extension 11 (FIG. 1) and wiring harness 8 to pass into the access area 12 where the connector 9 is connected to the ice maker 6.

Figure 5:
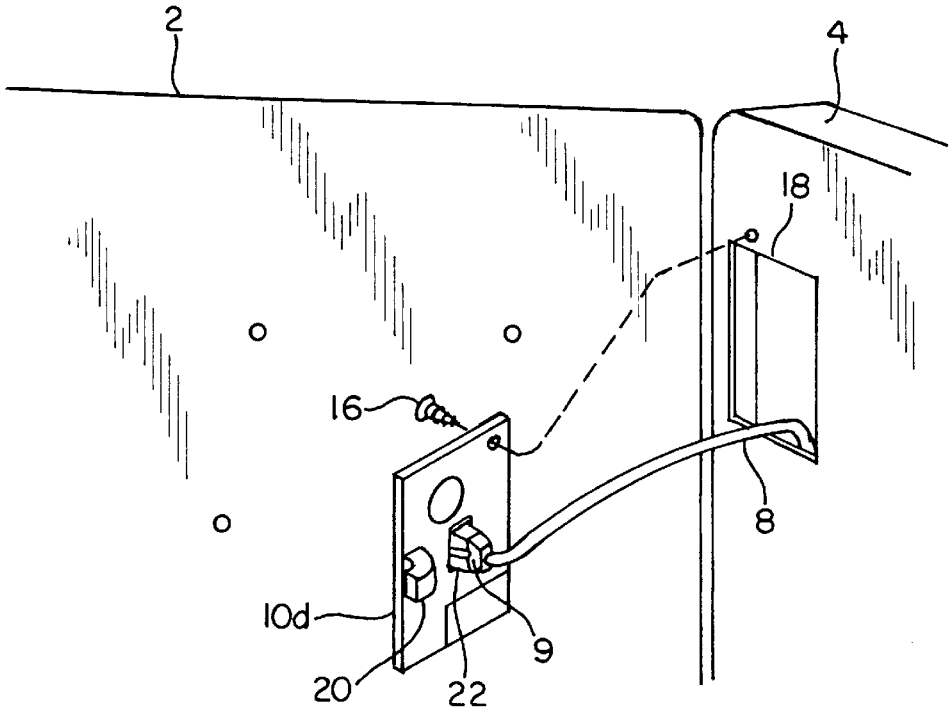
FIG. 5 is a view similar to FIG. 3 with the improved access panel removed.

FIG. 5 illustrates access area 12 with the invention of the improved access panel 10*d* removed from access opening 18. Access to access opening 18 is gained in the same manner as in the prior art. Fastener 16 is removed from the access panel 10*d*, then access panel 10*d* is moved to the left unhooking tab 20 from the freezer backwall 4 and access panel 10*d* may then be removed from access opening 18. Access to the ice maker wiring harness 8 and harness connector 9 by the installer of ice maker 6 is immediate because harness connector 9 is attached to the blind connector 22 on the access panel 10*d*, and ice maker wiring harness 8 will be pulled out of access opening 18 as access panel 10*d* is moved away from access opening 18. Spreadable tabs 24 (FIG. 4) may then be spread to disconnect connector 9 for attachment to ice maker 6. With the connector 9 removed, access panel 10*d* can be modified (FIG. 4) by breaking of section 26 and knocking out section 28.

The advantages provided by the improved access panel 10*d* of FIG. 5 is readily seen by a comparison of the part of the installation process that uses prior art access panel 10*c* of FIG. 3 with the same part of the process using the improved access panel 10*d*. Before the invention PRIOR ART FIG. 3), the ice maker kit installer removed the access panel 10*c*, then reached through access opening 18 to find the ice maker wiring harness 8 and then to pull wiring harness 8 through the access opening 18. The access opening 18 could be blocked by thermal insulation making it difficult to reach into access opening 18. The ice maker wiring harness 8 could be buried in the thermal insulation making wiring harness 8 difficult to find. Also, after reaching through the access opening 18 and finding a harness, the harness found may be other wiring 13 that is not used with ice maker 6, and additional searching would be required for the correct harness.

With the invention (FIG. 5), the ice maker kit installer removes the improved access panel 10*d*, and as the panel 10*d* is pulled forward the ice maker wiring harness 8 is pulled through the access opening 18. The ice maker wiring harness 8 is immediately available to the installer. The problems of reaching through access opening 18, the searching for the correct harness, and the possible finding of the wrong harness are all eliminate.

Further, with the invention (FIG. 5), the blind connector 22 of the improved access panel 10*d* locks the harness connector 9 inplace, which fixes the location and protects the electrical terminals 15 (FIG. 6) of the harness connection 9. The fixing and protecting removes the possibility of the electrical terminals coming into contact with other conductive items within the freezer wall as they might with the prior art arrangement.

The principles of the invention have now been described in connection with the preferred embodiment; however, it will be understood by those skilled in the are that modifications may be made in structure, arrangement, proportions, elements, materials, and components used in the practice of the invention that are particularly adapted for specific environment without departing from the scope and spirit of the following claims.

We claim:

1. An improved access panel for covering an access opening in a wall of an apparatus having a connective element on one side of the wall and an access area on the other side of the wall, wherein the connective element can be passed through the access opening into the access area, the improvement comprising:

a blind connector provided on the access panel for attaching the connective element to the access panel when the connective element is not being utilized, the connective element being removed with the access panel when it is desired to utilize the connective element in the access area.

2. The improved access panel of claim 1 wherein said connective element can be disconnected from said access panel when is desired to utilize said connective element.

3. The improved access panel of claim 2 wherein said connective element is a wiring harness having a connector at one end, said connector being attached to said blind connector when not in use, whereby removal of said access panel brings the connector and a portion of said wiring harness into the access area.

4. The improved access panel of claim 1 wherein said blind connector is molded into said access panel.

5. The improved access panel of claim 1 wherein said blind connector comprises two opposing walls and at least one flexible spreadable tab to hold said connective element in a position relative to said opposing walls.

6. The improved access panel of claim 1 wherein said blind connector is of a gender opposite that of said connective element.

7. The improved access panel of claim 1 wherein said blind connector comprises at least one flexible spreadable tab to hold said connective element in a position relative to said blind connector.

8. The improved access panel of claim 1 wherein said blind connector comprises at least one catch to hold a protrusion of said connective element such that said connective element is held in a position relative to said blind connector.

9. The improved access panel of claim 1 wherein said connective element is a harness.

10. The improved access panel of claim 8 wherein said blind connector mates with a harness connector of said harness.

11. The improved access panel of claim 9 wherein said harness connector has electrical terminals that are protected from touching other refrigerator parts by said blind connector.

12. A refrigerator-freezer with provisions for a later field installed ice maker, comprising:

an access panel for covering an access opening in a wall in said refrigerator-freezer;

a connective element on one side of said wall and an access area on the other side of said wall, wherein said connective element can be passed through said access opening into said access area;

a blind connector provided on said access panel for attaching said connective element to said access panel when said connective element is not being utilized; and said connective element being moved into said access area with said access panel as said access panel is removed from said access opening when it is desired to utilize said connective element for said ice maker in said access area.

* * * * *